US010272588B2

(12) United States Patent
Yoshida

(10) Patent No.: US 10,272,588 B2
(45) Date of Patent: Apr. 30, 2019

(54) SHEET PROCESSING APPARATUS

(71) Applicant: Kenji Yoshida, Yamanashi-ken (JP)

(72) Inventor: Kenji Yoshida, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 78 days.

(21) Appl. No.: 14/959,686

(22) Filed: Dec. 4, 2015

(65) Prior Publication Data

US 2016/0167249 A1 Jun. 16, 2016

(30) Foreign Application Priority Data

Dec. 15, 2014 (JP) ..... 2014-252742

(51) Int. Cl.

| | |
|---|---|
| ***B26F 1/00*** | (2006.01) |
| ***B26F 1/02*** | (2006.01) |
| ***B65H 35/00*** | (2006.01) |
| ***B65H 37/04*** | (2006.01) |

(52) U.S. Cl.

CPC ..... *B26F 1/0092* (2013.01); *B26F 1/02* (2013.01); *B65H 35/0086* (2013.01); *B65H 37/04* (2013.01)

(58) Field of Classification Search

CPC ..... G03G 15/00; B65H 15/00; B65H 29/22; B65H 43/04; B65H 35/0086; B65H 37/04; B26F 1/0092; B26F 1/02

See application file for complete search history.

(56) References Cited

U.S. PATENT DOCUMENTS

| | | | | |
|---|---|---|---|---|
| 8,457,543 | B2 | 6/2013 | Nagasako et al. | |
| 2004/0160503 | A1* | 8/2004 | Guerrero Zepeda | B41J 13/106 347/104 |
| 2006/0051147 | A1* | 3/2006 | Sato | G03G 15/6538 399/405 |
| 2009/0148210 | A1* | 6/2009 | Takenaka | G03G 15/234 399/381 |
| 2010/0119274 | A1* | 5/2010 | Nagasako | G03G 15/6552 399/405 |
| 2013/0093134 | A1* | 4/2013 | Mizubata | B65H 29/22 270/58.01 |
| 2013/0140765 | A1* | 6/2013 | Mizubata | B65H 3/66 271/254 |
| 2014/0151955 | A1* | 6/2014 | Yoshida | B65H 29/125 271/184 |
| 2014/0183811 | A1* | 7/2014 | Takenaka | B65H 43/02 271/3.19 |

(Continued)

FOREIGN PATENT DOCUMENTS

| | | |
|---|---|---|
| JP | 2008-247532 A | 10/2008 |
| JP | 2010-072024 A | 4/2010 |

(Continued)

OTHER PUBLICATIONS

Japan Patent Office, "Office Action for Japanese Patent Application No. 2014-252742," dated Feb. 9, 2018.

*Primary Examiner* — David H Banh
(74) *Attorney, Agent, or Firm* — Manabu Kanesaka

(57) ABSTRACT

Provided is a sheet processing apparatus having a configuration that a processing mechanism to perform a process on a sheet, a first conveying path to guide a sheet to the processing mechanism, and a second conveying path to guide a sheet are configured to be integrally removable from another component.

17 Claims, 7 Drawing Sheets

(56) References Cited

U.S. PATENT DOCUMENTS

| | | | | |
|---|---|---|---|---|
| 2015/0125165 | A1* | 5/2015 | Takenaka | B65H 43/02 399/21 |
| 2015/0183208 | A1* | 7/2015 | Yamawaki | B26F 1/00 399/407 |
| 2016/0334751 | A1* | 11/2016 | Kowase | B65H 29/125 |

FOREIGN PATENT DOCUMENTS

| | | | |
|---|---|---|---|
| JP | 2012-035956 | A | 2/2012 |
| JP | 2012-051685 | A | 3/2012 |

* cited by examiner

SHEET PROCESSING APPARATUS

BACKGROUND OF THE INVENTION

1. Field of the Invention

The present invention relates to a sheet processing apparatus that stores sheets after performing a predetermined process on the sheets.

2. Description of the Related Art

A main body apparatus such as a conventional image forming apparatus that forms an image on a sheet is provided with a sheet processing apparatus including a sheet processing device that performs a process on a sheet.

There have been known, as a sheet processing device, a binding mechanism for performing a binding process as collating and stacking sheets, a punching mechanism for punching file holes and storing sheets, a folding mechanism for performing a folding process and storing sheets, a printing mechanism for printing a predetermined stamp and storing sheets, and the like.

For example, Japanese Patent Application Laid-open No. 2012-51685 discloses a sheet processing apparatus that includes a punching mechanism and a binding mechanism as sheet processing devices. The sheet processing apparatus includes a first conveying path that discharges a sheet from an image forming apparatus to a stack tray after a punching process is performed by the punching mechanism and a binding process is performed by the binding mechanism, and a second conveying path that discharges a sheet from the image forming apparatus to a sheet discharge tray that is arranged on the stack tray as the sheet passing above the punching mechanism and the binding mechanism without performing a process thereon.

In general, a processing device by which a sheet is processed is prepared as an option. A user can select from a product with a processing device and a product without the processing device. For example, in Japanese Patent Application Laid-open No. 2008-247532, a punching mechanism, a binding mechanism, and a folding mechanism are arranged as sheet processing devices. Here, there have been provided a path that discharges sheets from an image forming apparatus to a stack tray after a punching process is performed by the punching mechanism and a binding process is performed by the binding mechanism, and a path that discharges sheets after the punching process is performed by the punching mechanism and a folding mechanism is performed by the folding mechanism.

In the apparatus, the punching mechanism is configured to be removable as an option. When the punching mechanism is removed, a conveying unit only having a conveying path is attached in replacement thereof.

In the apparatus including the second conveying path separately from the first conveying path for performing a process on a sheet as disclosed in Japanese Patent Application Laid-open 2012-51685, it is not considered to have a configuration that a processing mechanism is removed to be an optional structure.

SUMMARY OF THE INVENTION

A processing mechanism to perform a process on a sheet, a first conveying path to guide a sheet to the processing mechanism, and a second conveying path to guide a sheet are configured to be integrally removed. Accordingly, a portion having the processing mechanism is detachably attachable as an option separately from a portion to store a processed sheet at the downstream side of the first and second conveying paths.

BRIEF DESCRIPTION OF THE DRAWINGS

FIGS. 6A and 6B are schematic views illustrating a state that the processing apparatus is attached to a sheet discharging area of an image forming apparatus in the image forming system, while FIG. 6A illustrates a state that the first unit and the second unit are attached and FIG. 6B illustrates a state that the second unit is attached.

DESCRIPTION OF THE PREFERRED EMBODIMENTS

Figure 1:
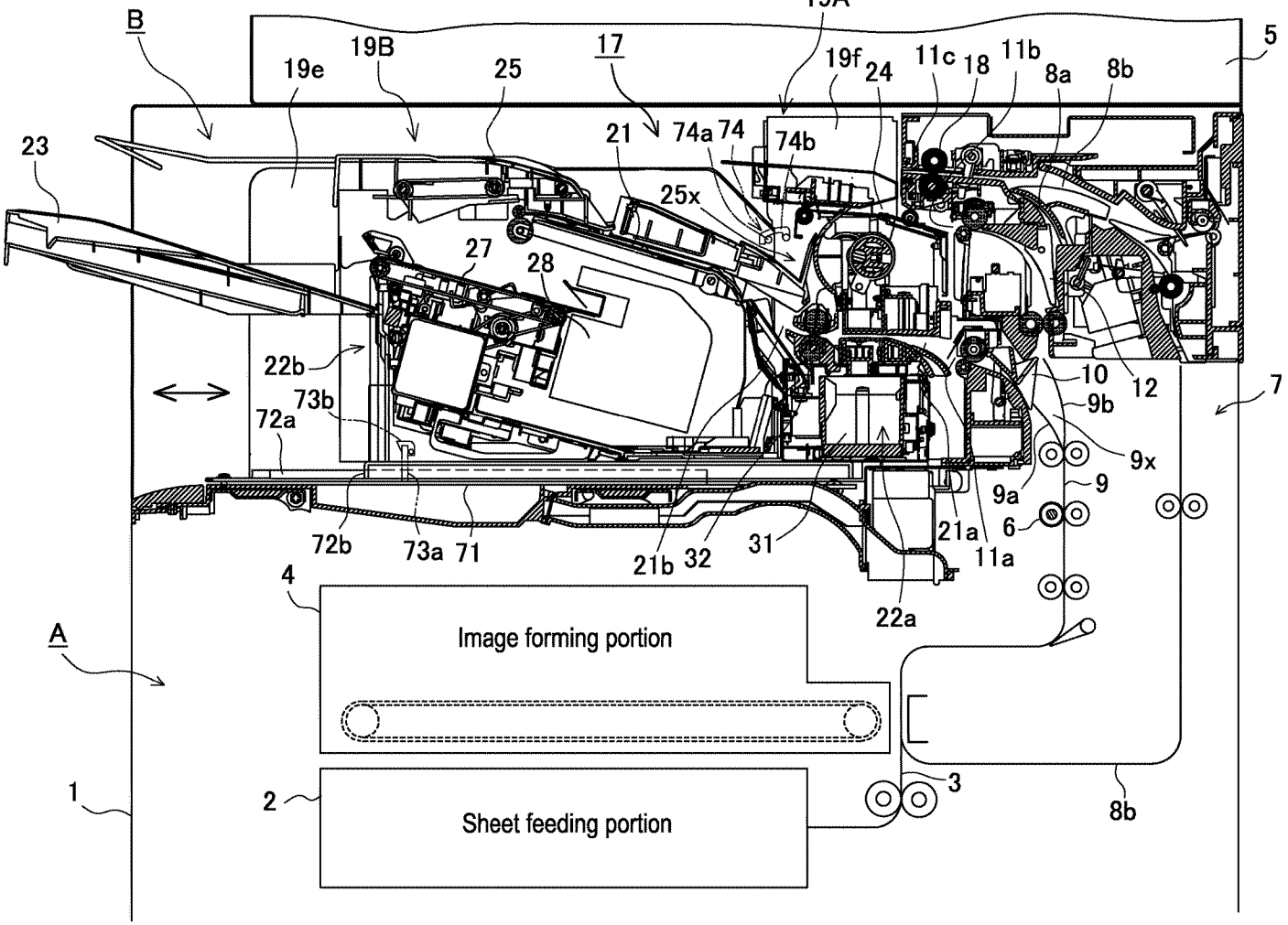
FIG. 1 is a sectional view illustrating a structure of an image forming system that includes a processing apparatus.

In the following, detailed description will be provided based on illustrated embodiments. FIG. 1 is a sectional view illustrating a structure of an image forming system that includes a processing apparatus. An image forming apparatus A and a post-processing apparatus B as a sheet processing apparatus are illustrated in FIG. 1. The image forming apparatus A forms an image on a sheet and discharges the sheet through a sheet discharging port 11*a*, 11*b* (hereinafter, called a body sheet discharging port). The sheet discharging port 11*a* is connected to an introducing port 20 of the post-processing apparatus B, so that the image-formed sheet is introduced into the post-processing apparatus B.

The post-processing apparatus B includes a conveying path 21 (first and third conveying paths described later), a first post-processing portion 22*a* and a second post-processing portion 22*b* that perform a post-process on a sheet respectively, and a stack tray 23 (first stack tray described later) that stores a post-processed sheet. In addition, the post-processing apparatus B is provided with a sheet discharging path 24, so that a sheet fed from the image forming apparatus A is stored on a second stack tray 25 without being post-processed.

In the present embodiment, a sheet fed from the image forming apparatus A to the sheet discharging path 24 is conveyed to the second stack tray 25 without being post-processed. Here, it is also possible that a third post-processing portion is arranged on the sheet discharging path 24 to convey a sheet to the second stack tray 25 after a post-process that is different from post-processes to be performed by the first and second post-processing portions 22*a*, 22*b* is performed on the sheet.

Next, description will be provided on the image forming apparatus A illustrated in FIG. 1. In the image forming apparatus A, a sheet feeding portion 2 that stores a sheet on which an image is to be formed, an image forming portion 4, a conveying portion 7, and an image reading portion 5 are arranged at an apparatus housing 1 (hereinafter, called a main body housing).

The main body housing 1 incorporates the sheet feeding portion 2, the image forming portion 4, and the conveying portion 7 in an unillustrated frame and the image reading portion 5 is arranged on the frame. An unillustrated feeder unit is integrally assembled in the image reading portion 5.

The sheet feeding portion 2 includes a plurality of sheet feeding cassettes that are capable of storing sheets having different sizes, and a sheet feeding path 3 that conveys a sheet from each sheet feeding cassette to the image forming portion 4.

A variety of methods have been known as a mechanism to form an image on a sheet. Any of them may be adopted as the image forming portion 4. For example, an electrostatic latent image is formed on a photoreceptor (a drum, an endless belt or the like) by a laser emitter, an LED emitter or the like, the latent image is developed with toner (ink), and then, an image is transferred on a sheet by a charger. After the image is fixed by a heating apparatus 6 (a fixing roller or the like), the sheet is discharged to the sheet discharging port 11*a* or the sheet discharging port 11*b* through a sheet discharging path 9.

Other than the abovementioned electrostatic printing mechanism, the image forming portion 4 may adopt an ink jet printing mechanism, a thermal printing mechanism, an offset printing mechanism, or the like.

The abovementioned conveying portion 7 includes the sheet discharging path 9 that conveys a sheet from the image forming portion 4 to the body sheet discharging port, and an unillustrated conveying device (a conveying roller, a conveying belt or the like). As the body sheet discharging port, the first sheet discharging port 11*a* and the second sheet discharging port 11*b* are arranged at different positions of the main body housing 1. The sheet discharging path 9 is branched into a first branched path 9*a* and a second branched path 9*b*. The first branched path 9*a* conveys a sheet to the first sheet discharging port 11*a* and the second branched path 9*b* conveys a sheet to the second sheet discharging port 11*b*.

A path switching device 10 is arranged at a branch part 9*x* of the sheet discharging path 9, so that sheets are conveyed as being sorted into the first and second branched paths 9*a*, 9*b*. For example, a sheet on which a post-process is to be performed is discharged from the first branched path 9*a* to the first sheet discharging port 11*a* and a sheet on which a post-process is not to be performed is discharged from the second sheet discharging path 9*b* to the second sheet discharging port 11*b*.

The first sheet discharging port 11*a* is connected to the first stack tray 23 that stores a sheet on which a post-process is performed at the later-mentioned post-processing apparatus B. The second sheet discharging port 11*b* is connected to the second stack tray 25 that stores a sheet on which a post-process is not performed.

A sheet discharge area 17 is arranged at the downstream side of the first and second sheet discharging ports 11*a*, 11*b*. The post-processing apparatus B is attached to the sheet discharge area 17. As illustrated in FIG. 1, the sheet discharge area 17 is formed at a space below which the image forming apparatus A is arranged and above which the image reading portion 5 is arranged.

Further, the conveying portion 7 is provided with a duplex path 8 that face-reverses an image-formed sheet and refeeds the sheet to the image forming portion 4. In the illustrated apparatus, aside from the second branched path 9*b* that conveys a sheet to the second sheet discharging port 11*b*, the duplex path 8 is arranged for conveying a sheet from the second sheet discharging port 11*b* to the image forming portion 4.

In the following, description will be provided on the duplex path 8. Aside from the first and second sheet discharging ports 11*a*, 11*b*, a third sheet discharging port 11*c* is arranged at the image forming apparatus A. The third sheet discharging port 11*c* is connected to a switchback path 8*a* that reverses a sheet conveying direction and a U-turn path 8*b* that face-reverses the sheet fed from the switchback path 8*a* and conveys the sheet to the sheet feeding path 3.

A second path switching device 12 is arranged at the sheet discharging path 9*b* in a direction toward the second sheet discharging port 11*b* so as to guide a sheet to the second sheet discharging port 11*b* or the third sheet discharging port 11*c*. The sheet guided to the third sheet discharging port 11*c* is conveyed in a direction opposite to the conveying direction along the switchback path 8*a* due to reverse rotation of a forward-reverse roller 18 and is guided to the U-turn path 8*b*. Thus, the sheet is face-reversed and is fed to the sheet discharging path 9 after an image is formed on a back face thereof.

The image reading portion 5 includes a platen on which an original sheet is placed, a carriage that scans the original sheet, and a reading element that photoelectrically converts reflection light of an original image scanned by the carriage (not illustrated). A feeder unit that feeds original sheets is arranged on the platen in a mountable manner, so that the original sheets set on a sheet feeding tray are conveyed to a reading part of the platen as being separated one by one and are stored on a sheet discharging tray after image reading. The image reading portion 5 is mounted above the sheet discharge area 17 of the image forming apparatus A.

The image forming apparatus A may be structured as a stand-alone apparatus or a network terminal apparatus such as a printer, a copy machine, a fax machine, and a printing machine.

As illustrated in FIG. 1, the post-processing apparatus B includes the first and second post-processing portions 22*a*, 22*b*, the first and second stack trays 23, 25, an upstream side sheet path 21*a* (the first conveying path) and a downstream side sheet path 21*b* (the third conveying path) continuing therefrom, and the sheet discharging path 24 (a second conveying path) that is arranged above the upstream side sheet path 21*a*.

The post-processing apparatus B is attached to the sheet discharge area 17 that is formed in the main body housing 1 of the image forming apparatus A as including a first unit 19A at the upstream side in the sheet discharging direction and a second unit 19B at the downstream side therein. The first unit 19A and the second unit 19B are structured in a separable manner to be selectively mountable at the sheet discharge area 17.

Figure 2:
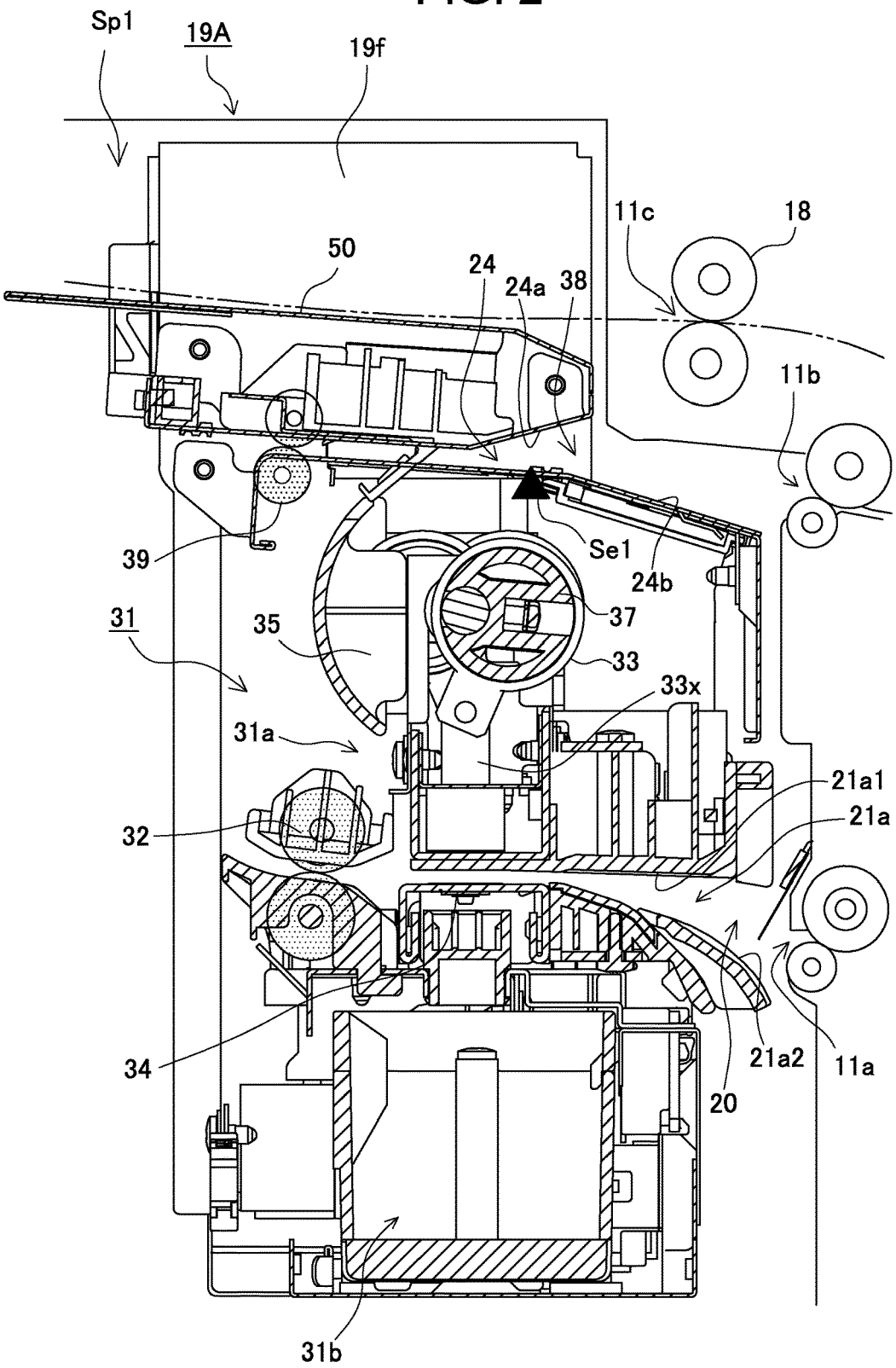
FIG. 2 is a sectional view illustrating a structure of a first unit in the processing apparatus of FIG. 1.
Figure 3:
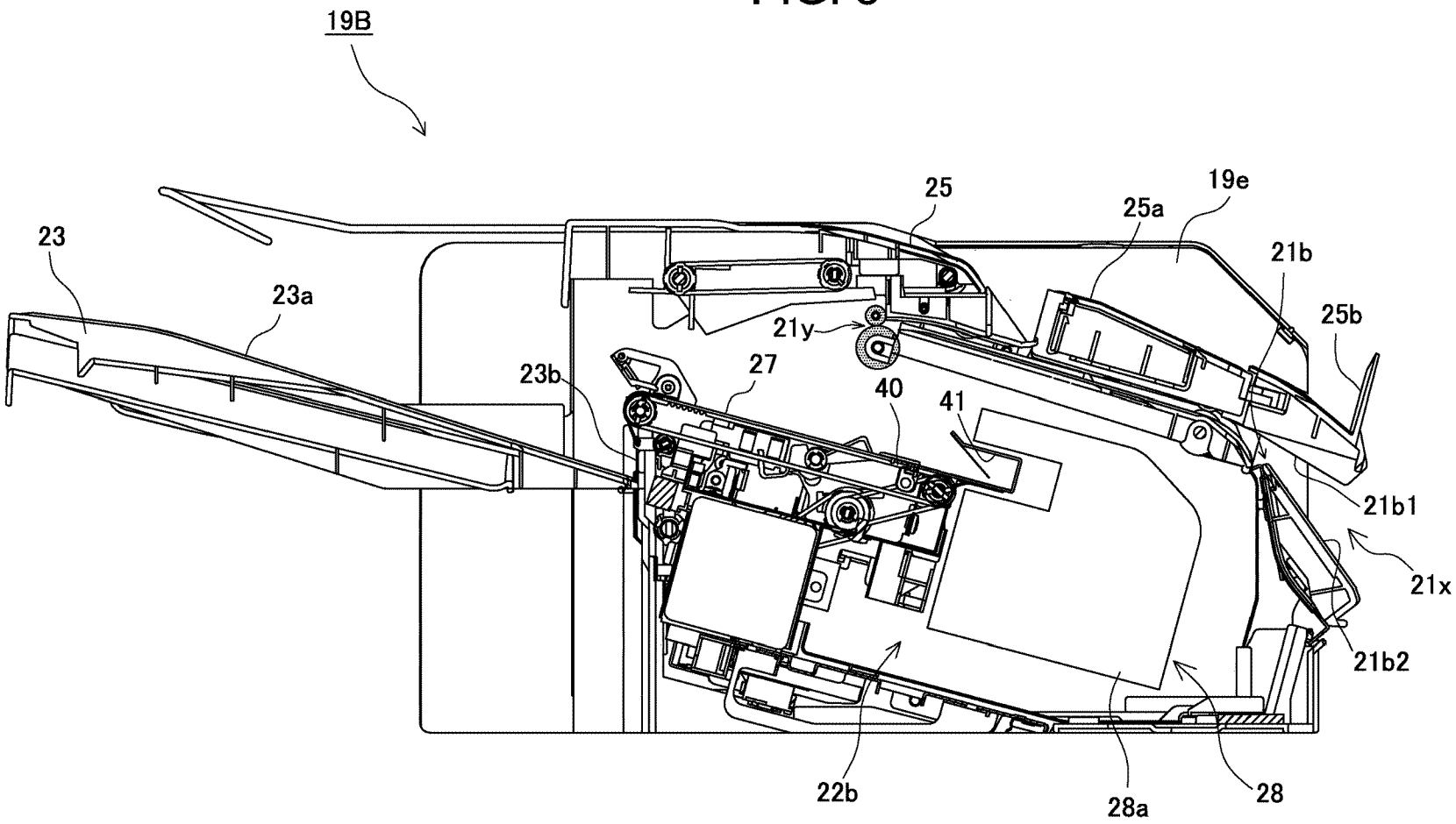
FIG. 3 is a sectional view illustrating a structure of a second unit in the processing apparatus of FIG. 1.

FIG. 2 is a sectional view illustrating the first unit 19A and FIG. 3 is a sectional view illustrating the second unit 19B. As illustrated in FIG. 2, the first unit 19A includes the first post-processing portion 22*a* at which a punching device 31 (a first post-processing device) is arranged, the upstream side sheet path 21*a* that guides a sheet to the first post-processing portion 22*a*, the sheet discharging path 24, a first discharging roller pair 32 (first conveying device) that conveys a sheet along the upstream side sheet path 21*a*, and a second discharging roller pair 39 (second conveying device) for discharging the sheet that is guided through the sheet discharging path 24.

The sheet discharging path 24 is arranged above the upstream side sheet path 21*a*. The sheet discharging path 24 and the upstream side sheet path 21*a* are formed approximately in parallel. Here, a space Sp1 in which the punching device 31 is arranged is needed at the upstream side sheet path 21*a* and a sheet stack space Sp2 for the second stack tray 25 arranged at the downstream side is needed at the sheet discharging path 24.

Owing to that the sheet discharging path 24 is arranged above the upstream side sheet path 21*a*, spaces can be effectively distributed and space-saving can be achieved. Further, a guide face 50 for supporting a sheet that is to be switched back through the third sheet discharging port 11*c* of the conveying portion 7 of the image forming apparatus A is formed at an upper face of the first unit 19A. The guide face 50 is exposed to the outside as illustrated in FIG. 1 and serves as a part of exterior of the post-processing apparatus B.

In the following, the first unit 19A will be described in more detail. A unit frame 19*f* has a frame structure to be attached to the main body housing 1. The unit frame 19*f* supports the punching device 31 that performs punching on a sheet, the upstream side sheet path 21*a* that guides a sheet for being punched by the punching device 31, the sheet discharging path 24 that guides a sheet on which a post-process is not performed as being arranged above the upstream side sheet path 21*a*, the first discharging roller pair 32 that conveys a sheet in the upstream side sheet path 21*a* to the downstream side, and the second discharging roller pair 39 that discharges a sheet guided to the sheet discharging path 24 to the second stack tray 25 of the second unit 19B. The upstream side sheet path 21*a* is arranged at a position so that the introducing port 20 (first introducing port) is matched to the first sheet discharging port 11*a*. The upstream side sheet path 21*a* is structured with an upper paper guide 21*a*1 and a lower paper guide 21*a*2 that guide a sheet to the downstream side (to the inside of the post-processing apparatus B).

The punching device 31 that performs a post-process on a passing sheet is arranged at the upstream side sheet path 21*a*. Further, the first discharging roller pair 32 is connected to an unillustrated driving motor as being arranged to convey a sheet at the upstream side sheet path 21*a*. A controller (a later-mentioned control CPU 60 or the like) that is connected to a driver of the driving motor is configured to temporarily stop a sheet at a punching position.

The punching device 31 includes a punching mechanism 31*a* that performs punching on a sheet that passes through the upstream side sheet path 21*a*, and a waste box 31*b* that stores broken pieces of sheets on which punching is performed by the punching mechanism 31*a*.

Next, a structure of the punching mechanism 31*a* will be described. In the punching mechanism 31*a*, a punching member 33 having a punching blade 33*x* and a die member 34 having a blade receiving hole are arranged as being opposed to each other with the upstream side sheet path 21*a* located therebetween. The punching member 33 is bearing-supported by a frame unit 35 to be capable of being vertically moved by a predetermined stroke. A punch driving device that performs vertical moving is connected to the punching member 33.

The punch driving device includes a driving motor (not illustrated) and a driving cam 37 that is connected thereto. The illustrated driving cam 37 is formed as an eccentric cam and is link-connected to the punching member 33. A driver of the driving motor of the punch driving device is connected to the later-mentioned control CPU 60, so that the control CPU 60 controls the driving motor.

The punching mechanism 31*a* is structured as a shifting mechanism that reciprocates one or plural punching members 33 by a predetermined stroke between a top dead point and a bottom dead point as being structured with the driving cam 37, the driving motor, and the like. Other than the above, it is possible to adopt, as the punching mechanism, a mechanism (rotary punching mechanism) that punches file holes on a passing sheet with rotation of a rotor with a protruded punching member integrally formed around the rotor.

The sheet discharging path 24 is arranged above the upstream side sheet path 21*a* as being approximately in parallel thereto. The sheet discharging path 24 is arranged at the unit frame 19*f* as being located at a position so that a conveying path is formed by an upper-lower pair of paper guides 24*a*, 24*b* and that an introducing port 38 (second introducing port) thereof is connected to the second sheet discharging port 11*b*.

The sheet discharging roller pair 39 is arranged at the sheet discharging path 24 and is connected to an unillustrated driving motor. A driver of the driving motor of the sheet discharging roller pair 39 is connected to the later-mentioned control CPU 60, so that the control CPU 60 controls the driving motor. The illustrated sheet discharging roller pair 39 is attached to the unit frame 19*f*.

As illustrated in FIG. 3, a binding device 28 (second post-processing device) is arranged at the second post-processing portion 22*b* of the second unit 19B. The binding device 28 includes a processing tray 27 that is attached to a unit frame 19*e* and a binding mechanism 28*a* that is attached to the processing tray 27. The illustrated processing tray 27 collates and stacks sheets.

Further, the second unit 19B is provided with the first stack tray 23 that stores a post-processed sheet and the second stack tray 25 that stores a sheet fed from the image forming apparatus A without being post-processed. That is, the second unit 19B also serves as a sheet storing unit (sheet storing portion) for storing sheets. The second unit 19B is provided with the downstream side sheet path 21*b* that is formed as being connected to the upstream side sheet path 21*a* of the first unit 19A and guides a sheet to the second post-processing portion 22*b*. In the following, detailed description will be provided on the second unit 19B.

The downstream side sheet path 21*b* is structured with an upper and lower pair of paper guides 21*b*1, 21*b*2 to guide a sheet from the abovementioned upstream side sheet path 21*a*. A path entering port 21*x* of the downstream side sheet path 21*b* is capable of being connected to the upstream side sheet path 21*a* that is located at the upstream side and is arranged at a height position to be also connected to the first sheet discharging port 11*a* of the image forming apparatus A.

As described above, the binding device 28 is arranged at the second post-processing portion 22*b*. The binding device 28 includes the processing tray 27 that stacks sheets as being arranged at the downstream side of the upstream side sheet path 21*a*, the binding mechanism 28*a* that performs a binding process on the stacked sheets, and a conveying belt 40 that conveys a sheet bundle at the second post-processing portion 22*b* to the first stack tray 23.

The processing tray 27 is arranged at the downstream side of the sheet discharging port 21*y* of the downstream side sheet path 21*b* as forming a stepped part therefrom. The processing tray 27 includes a support face that stacks and supports a sheet tailing end part. The processing tray 27 is provided with a stopper member 41 that positionally regulates a sheet tailing end. Further, the binding mechanism 28*a* is arranged at one end side of the processing tray 27. Since the mechanism of the binding mechanism 28*a* has been known as an apparatus to perform a binding process on a sheet bundle stacked on a tray, description thereof is skipped.

Here, a driving unit of the binding mechanism 28*a* is connected to the later-mentioned control CPU 60, so that the control CPU 60 controls the driving unit. Further, the second unit 19B is provided with an aligning portion that performs abutting-aligning as causing a sheet conveyed to the processing tray 27 to be conveyed toward the stopper member 41 and that performs aligning on a sheet with respect to a direction intersecting to the sheet conveying direction. A driving unit for operating the aligning portion is connected to the later-mentioned control CPU 60, so that the control CPU 60 controls the driving unit.

The conveying belt 40 has a mechanism in which a lock claw that locks a sheet bundle is formed integrally with a belt that moves in a front-back direction. The conveying belt 40 conveys a sheet bundle along the support face of the processing tray 27. A driver of a driving motor (not illustrated) for rotating the conveying belt 40 is connected to the later-mentioned control CPU 60, so that the control CPU 60 controls the driving motor.

The first stack tray 23 is arranged at the downstream side of the processing tray 27 and is attached to the unit frame 19*e*. The first stack tray 23 includes a placement face 23*a* on which a sheet is stacked and a regulation face 23*b* that positionally regulates sheet tailing end in the sheet discharging direction. Sheets fed from the processing tray 27 are stored as being stacked sequentially on the upper side along the regulation face 23*b*.

Figure 5:
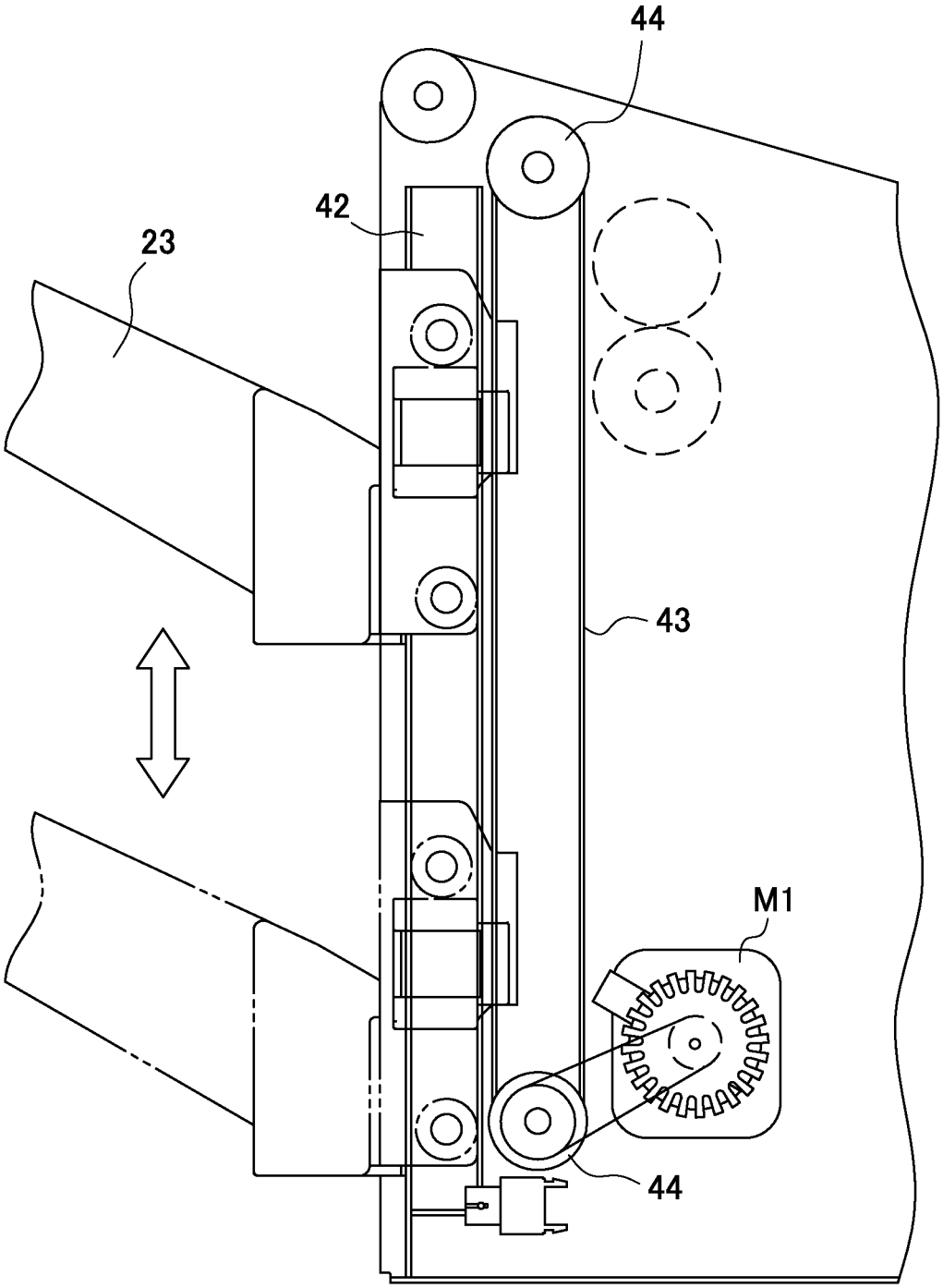
FIG. 5 is a sectional view illustrating a lifting-lowering mechanism of a first stack tray in the processing apparatus.

Here, as illustrated in FIG. 5, the first stack tray 23 is configured to be capable of being lifted and lowered to be moved upward and downward in accordance with a stack amount of sheets. A base part of the first stack tray 23 is supported by a guide rail 42 to be movable in a stacking direction and is pulled by a hoist belt 43 and the like. A forward-reverse motor M1 is connected to a pulley 44 of the hoist belt 43, so that a height position of the first stack tray 23 is shifted upward and downward with forward and reverse rotation of the forward-reverse motor M1.

Further, as illustrated in FIG. 3, the second stack tray 25 is arranged on an upper face of the second unit 19B. The second stack tray 25 includes a tray face 25*a* on which a sheet is stacked and stored and a regulation face 25*b* that positionally regulates a sheet tailing end. The second stack tray 25 serves as a part of exterior of the post-processing apparatus B. A sheet introducing port 25*x* of the second stack tray 25 illustrated in FIG. 1 is arranged at a height position to be connected to the downstream side of the sheet discharging path 24 of the first unit 19A. The sheet introducing port 25*x* is also arranged at a height position to be connected to the second sheet discharging port 11*b* of the image forming apparatus A.

Figure 4:
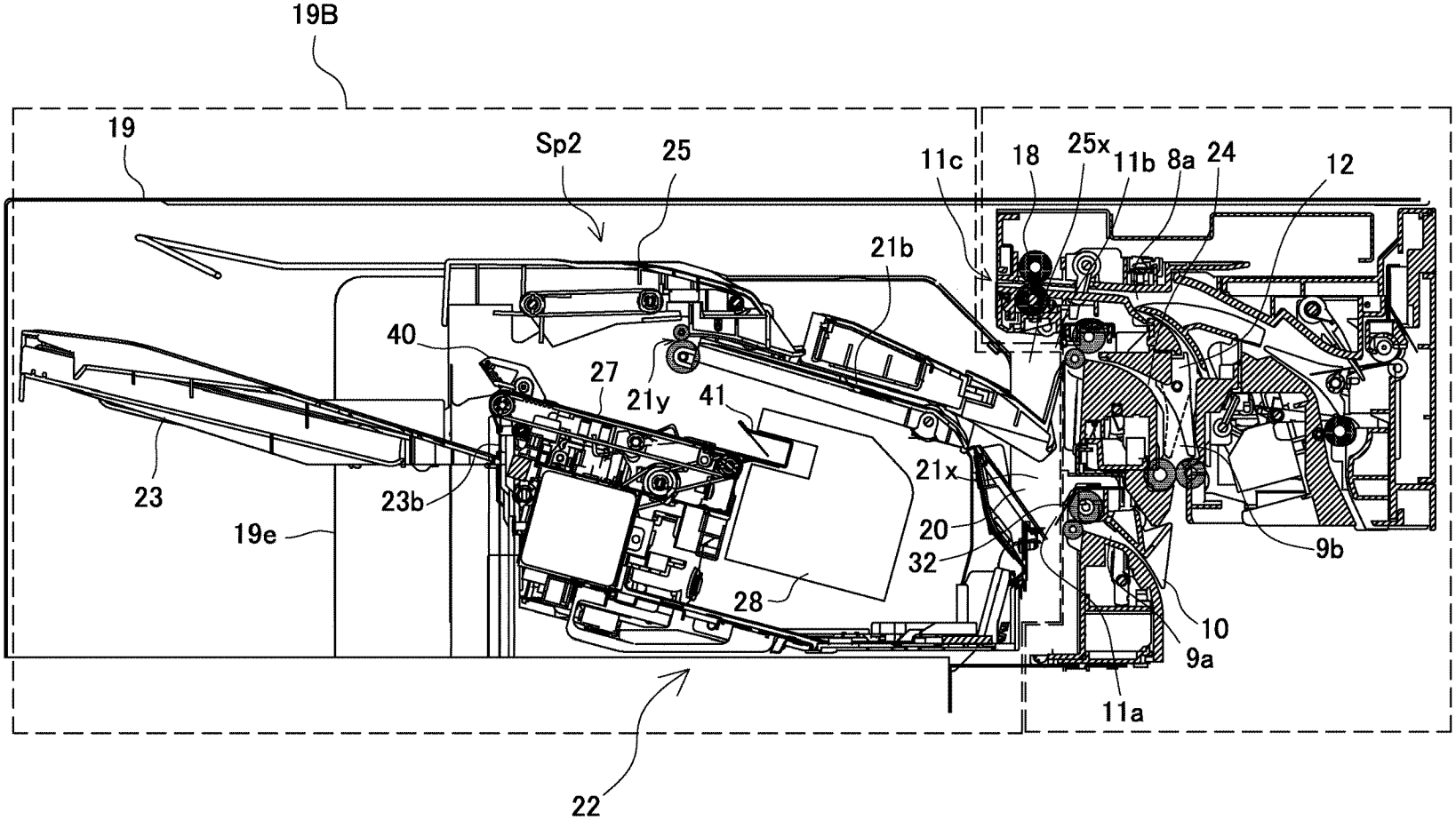
FIG. 4 is a sectional view illustrating the image forming apparatus in a state that the first unit is detached as an option from the processing apparatus of FIG. 1.

According to the above, the first unit 19A and the second unit 19B can be attached to the sheet discharge area 17 so that sheets are introduced thereto from the image forming apparatus A. Further, as illustrated in FIG. 4, it is also possible to attach the second unit 19B so as to receive a sheet from the image forming apparatus A without attaching the first unit 19A to the image forming apparatus A.

In the former case, the first sheet discharging port 11*a* is connected to the introducing port 20 of the upstream side sheet path 21*a*. In the latter case, the first sheet discharging port 11*a* is connected to the path entering port 21*x*. Thus, users can select from an optional structure in which the first unit 19A and the second unit 19B are attached to the sheet discharge area 17 and an optional structure in which the second unit 19B is attached while the first unit 19A is not attached.

In the above embodiment, the second unit 19B is structured with the first stack tray 23, the second stack tray 25, and the binding device 28. However, it is also possible that the second unit 19B is structured with a storing mechanism (storing portion) as being the first stack tray 23 and the second stack tray 25 without including the binding device 28. Further, it is also possible to arrange a printing mechanism to print a mark on a sheet or a folding mechanism to perform a folding process on a sheet instead of the binding device 28.

In the above configuration, the second unit 19B is provided with a second stack tray 25, the processing tray 27 located below the second stack tray 25, and the first stack tray 23 located below the processing tray 27. Here, as illustrated in FIG. 5, the regulation face (third regulation face) 25*b* of the second stack tray 25, a regulation face (second regulation face) 27*b* of the processing tray 27, and the regulation face (first regulation face) 23*a* of the first stack tray 23 are arranged in the order thereof as being mutually distanced in a movement direction of the first stack tray 23 (a direction of an arrow in FIG. 5).

Figure 6A:
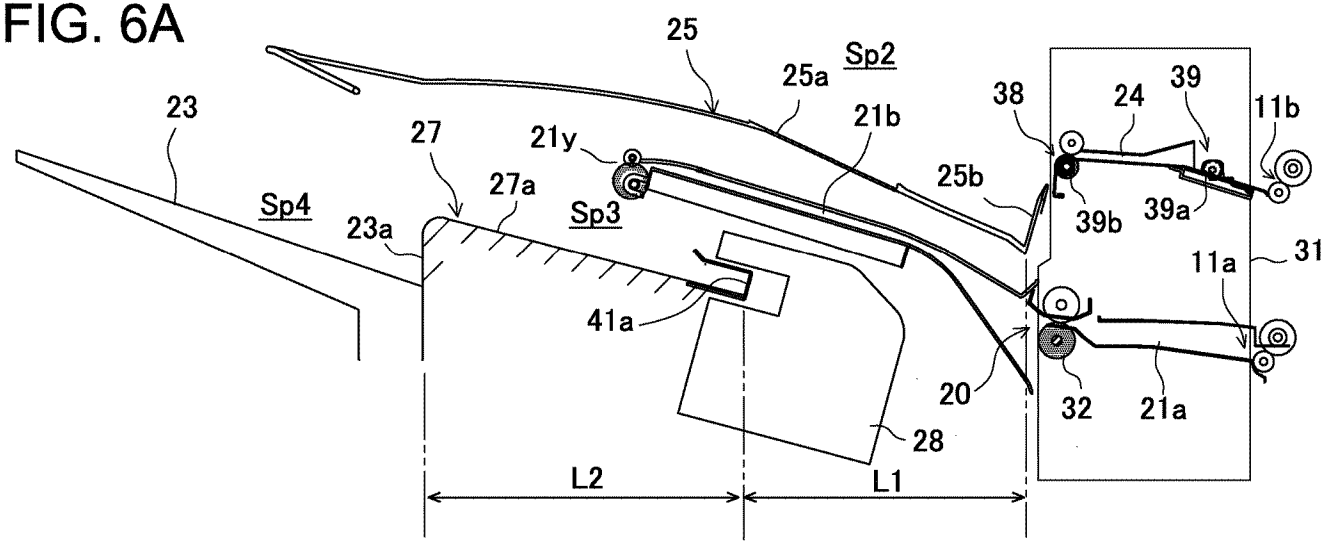
Figure 6B:
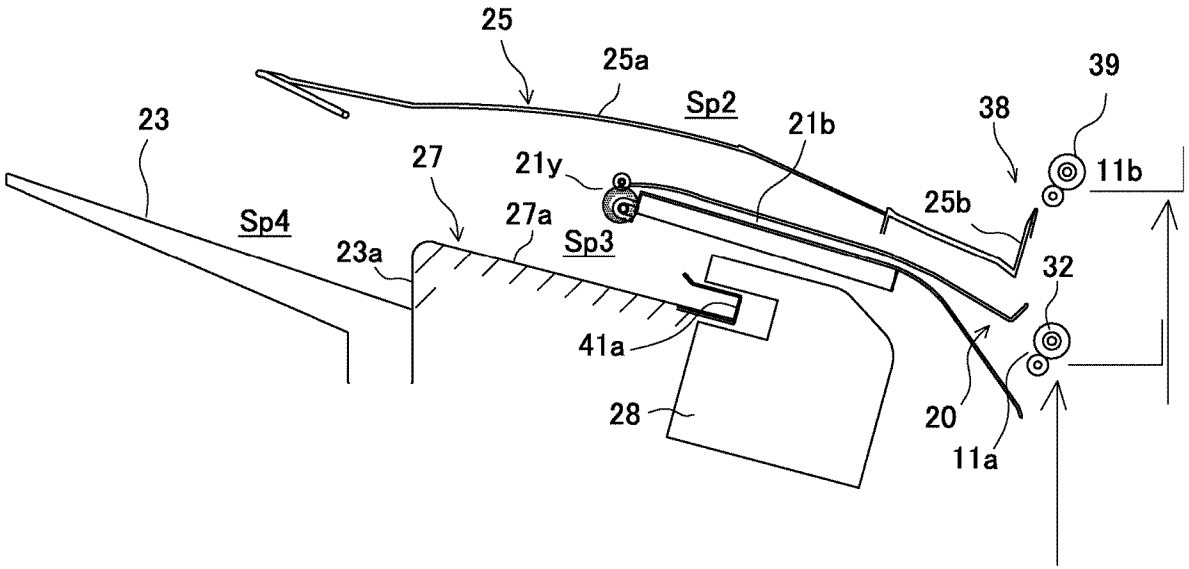

Here, description will be provided on a positional relation among the first, second, and third regulation faces 23*a*, 41*a*, 25*b*. As illustrated in FIGS. 6A and 6B, the first regulation face 23*a*, the second regulation face 41*a*, and the third regulation face 25*b* are arranged in the order of the third regulation face 25*b*, the second regulation face 41*a*, and the first regulation face 23*a* as being mutually distanced in the sheet discharging direction of sheets fed from the image forming apparatus A.

A distance L1 is formed between the third regulation face 25*b* and the second regulation face 41*a* and a distance L2 is formed between the second regulation face 41*a* and the first regulation face 23*a*. According to the above, since sheets stored on the respective trays are stored with sheet ends shifted in position in the order of the second stack tray 25 at the top, the processing tray 27 at the middle, and the first stack tray 23 at the bottom, a user can recognize that which sheet is stored on which tray at a glance. According to the above, since a storage space Sp2 of the second stack tray 25, a storage space Sp3 of the processing tray 27, and a storage space Sp4 of the first stack tray 23 are arranged as being imbricated without being vertically aligned, it is easy to perform operation to take out a sheet from each tray.

In the following, specific description will be provided on attaching of the first unit 19A and the second unit 19B in the present embodiment. As illustrated in FIG. 1, a plate-shaped attachment base 71 is attached to the housing 1 of the image forming apparatus A. Rails 72 are arranged at two positions of the attachment base 71, respectively. Each rail 72 includes a fixed rail 72*a* that is fixed to the attachment base 71 and an attachment rail 72*b* that is slide-movable with respect to the fixed rail 72*a*. The unit frame 19*e* of the second unit 19B is attached to the attachment rail 72*b*.

That is, the second unit 19B is attached in a slide-movable manner in an arrow direction in FIG. 1 (in the conveying direction of a sheet and a direction opposite to the conveying direction) with the rails 72. When attaching the second unit 19B to the housing 1, a worker engages the attachment rail 72*b* with the fixed rail 72*a* at a position apart from the conveying portion 7 of the image forming apparatus A and slides the second unit 19B along the rails 72 to attach the second unit 19B.

Further, the first unit 19A is attached to the second unit 19B to be supported on the rails 72. The first unit 19A is connected to the second unit 19B with a first connecting mechanism 74.

According to the abovementioned configuration, connection of the first unit 19A and the second unit 19B is performed at a position being apart from the conveying portion 7 of the image forming apparatus A owing to that the first unit 19A is connected to the second unit 19B by a worker with the first connecting mechanism 74. The worker moves the first unit 19A and the second unit 19B in a connected state along the rails 72. At a position where the first unit 19A is connected to the conveying portion 7 of the image forming apparatus A, a bottom part of the unit frame 19*f* of the first unit 19A is fixed to the attachment base 71 with a screw as a fixture. Thus, the first unit 19A is fixed to the housing 1. Further, the second unit 19B is held by the housing 1 by being connected to the attachment base 71 with a second connecting mechanism 73.

In the case that the first unit 19A is not to be attached to the housing 1, the second unit 19B is attached to the housing 1 owing to that a worker moves the second unit 19B along the rails 72 to a position where the second unit 19B is connected to the conveying portion 7 of the image forming apparatus A without connecting the first unit 19A to the second unit 19B.

The first connecting mechanism 74 includes a claw member 74*b* arranged at the first unit 19A and an engagement member 74*b* that is to be engaged with the claw member 74*b* as being arranged at the second unit 19B. According to the abovementioned configuration, owing to that a worker engages the claw member 74*b* of the first unit 19A with the engagement member 74*a* of the second unit 19B to integrally connect the first unit 19A and the second unit 19B, the first unit 19A and the second unit 19B can be integrally connected to the conveying portion 7 of the image forming apparatus A.

Further, as illustrated in FIG. 1, the second connection mechanism 73 includes a convex portion 73*a* that is arranged at the attachment base 71 and a rotatable claw member 73*b* that is arranged at the second unit 19B. According to the abovementioned configuration, the second unit 19B can be held by the housing 1 owing to that a worker causes the claw member 73*b* of the second unit 19B to be engaged with the convex portion 73*a* of the attachment base 71.

In the abovementioned embodiment, the second unit 19B is configured to be slide-moved with the rails 72. Here, it is also possible that a slide convex portion is arranged at the attachment base 71 and a slide groove is arranged at the second unit 19B and the slide convex portion is fitted to the slide groove, so that the second unit 19B can be slid along the slide convex portion.

Further, in the abovementioned embodiment, the first unit 19A and the second unit 19B are configured to be slidable in a connected state. Here, it is also possible that the first unit 19A is configured to be capable of being directly attached to the attachment base 71 while only the second unit 19B is configured to be slidable. In this case, a worker attaches the first unit 19A to the attachment base 71 with a fixture such as a screw at a position where the first unit 19A is attached to the conveying portion 7 and slide-moves the second unit 19B to connect the second unit 19B and the first unit 19A.

Figure 7:
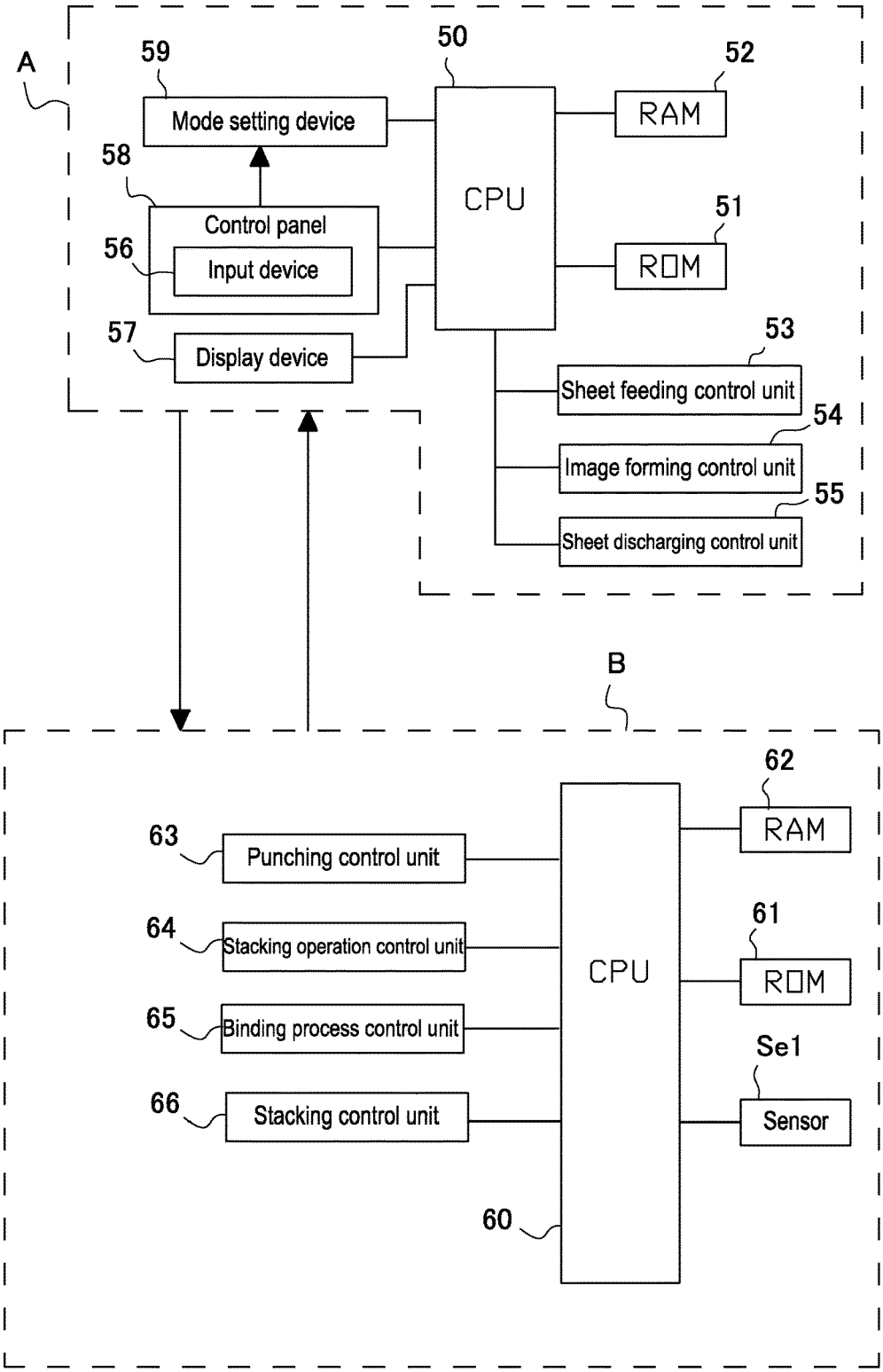
FIG. 7 is a block diagram illustrating a control configuration of the image forming system of FIG. 1.

Next, a control configuration of the image forming system illustrated in FIG. 1 will be described according to a block diagram of FIG. 7. A control CPU 50 is arranged in the image forming apparatus A. A ROM 51 storing an operating program and a RAM 52 storing control data are connected to the control CPU 50. The control CPU 50 includes a sheet feeding control unit 53, an image forming control unit 54, and a sheet discharging control unit 55. Further, a display device 57 and a control panel 58 having an input device 56 are connected to the control CPU 50.

Further, a mode setting device 59 is arranged at the control CPU 50 to allow a print-out mode or a post-processing mode to be selected. In the print-out mode, an image-formed sheet is stored on the stack tray 25 (second stack tray) without a finishing process performed thereon. In the post-processing mode, image formed sheets are stored on the stack tray 23 (first stack tray) after the sheets are collated and stacked and a post-process such as a binding process is performed thereon.

A CPU 60 for post-process controlling is arranged in the post-processing apparatus B and a ROM 61 storing a control program and a RAM 62 storing control data are connected thereto. The control CPU 60 receives sheet size information, a sheet discharging direction signal, and a mode setting command of the post-processing mode and the print-out mode from the control CPU 50 of the image forming apparatus A.

The control CPU 60 includes a punching control unit 63 for performing a punching process on an image-formed sheet, a stacking operation control unit 64 that collates and stacks sheets on the processing tray 27, a binding process control unit 65, and a stacking control unit 66.

When the post-processing mode is set by the control CPU 50 of the image forming apparatus A, the image forming apparatus A forms an image on a sheet and conveys the sheet to the first sheet discharging port 11*a*. When the print-out mode is set or an interrupt mode is set, the image forming apparatus A conveys the sheet to the second sheet discharging port 11*b*. Here, the interrupt mode is a control mode to perform a subsequent job in a mid-course of an operation of continuously performing an image forming operation in the image forming apparatus A while interrupting the operation.

When a command signal of the post-processing mode is received from the image forming apparatus A, the CPU 60 for post-process controlling causes the second discharging roller pair 39 that conveys a sheet along the sheet discharging path 24 to be activated or prepared in the print-out mode. Alternatively, the CPU 60 for post-process controlling causes the first discharging roller pair 32 that conveys a sheet along the upstream side sheet path 21*a* to be activated or prepared.

In the print-out mode, the CPU 60 for post-process controlling rotates the second discharging roller pair 39 based on that an inlet sensor Se1 at the second introducing port 38 detects a sheet leading end and discharges the sheet to the second stack tray 25 at the downstream side.

In the post-processing mode, the sheet is discharged to the downstream side by rotation of the first discharging roller pair 32. In a mode to perform a post-process at the punching device 31, the sheet is stopped at a punching position in the path. The position of the sheet stopping is controlled by a rotation amount of the driving motor of the first sheet discharging roller pair 32. Then, the CPU 60 for post-process controlling sends a command signal of punching operation prosecution to the punching device 31.

Subsequently, when an operation completion signal is received from the punching device 31, the CPU 60 for post-process controlling re-drives the first sheet discharging roller pair 32 and discharges the sheet through the path sheet discharge port at the downstream side. The sheet is conveyed to the processing tray 27. A subsequent sheet is placed on an antecedent sheet to be stacked. When a job completion signal is received from the image forming apparatus A, the CPU 60 for post-process controlling performs a binding process on sheets stacked on the processing tray 27.

Subsequently, the CPU 60 for post-process controlling conveys a sheet bundle on which a binding process is performed on the processing tray 27 and stores the sheet bundle on the stack tray 23 (first stack tray) at the downstream side.

According to the present embodiment, the first unit 19A includes, as an integral unit, the punching device 31 that performs punching on a sheet, the upstream side sheet path 21*a* that guides a sheet on which punching is to be performed by the punching device 31, the sheet discharging path 24 that guides a sheet without a post-process performed thereon as being arranged above the upstream side sheet path 21*a*, the first discharging roller pair 32 that conveys a sheet in the upstream sheet path 21*a* to the downstream side, and the second discharging roller pair 39 that discharges a sheet guided to the sheet discharging path 24 to the second stack tray 25 of the second unit 19B. Then, the first unit 19A is configured to be connected to the second unit 19B that includes the first and second stack trays 23, 25. Accordingly, it is easy to handle the first unit 19A as an option.

Here, the first discharging roller pair 32 for performing positioning of a sheet on which punching is to be performed by the punching device 31 is arranged at the first unit 19A, the upstream side sheet path 21*a* is formed approximately linearly, and the first discharging roller pair 32 is arranged in the vicinity of the punching device 31. Accordingly, accuracy is improved for positioning of a sheet on which punching is to be performed.

Further, according to the present embodiment, the second unit 19B is connected to the first unit 19A when the first unit 19A is mounted as an option unit, while the second unit 19B is connected to the conveying portion 7 of the image forming apparatus A when the first unit 19A is removed. Accordingly, it is possible to easily vary an apparatus structure in accordance with usage thereof. Further, when the first unit 19A is removed, the apparatus can be miniaturized.

According to the present embodiment, since the guide face 50 for supporting a sheet that is conveyed as being reversed at the conveying portion 7 of the image forming apparatus A in the direction of being conveyed is arranged on the upper face of the first unit 19A, the unit can be miniaturized. Further, since the upper face of the second unit 19B is arranged at the second stack tray 25, the unit can be simplified and miniaturized. In addition, it is possible to increase a storing amount of sheets to be stored on the second stack tray 25.

Further, since the second stack tray 25 is arranged above the binding device 28 to directly receive a sheet from the second discharging roller pair 39 of the first unit 19A, the sheet discharging path 24 from the image forming apparatus A to the second stack tray 25 can be shortened, so that sheet conveyance error can be reduced.

Further, owing to that end parts of the second stack tray 25, the processing tray 27 of the binding device 28, and the first stack tray 23 that regulate sheet tailing ends are arranged as being mutually distanced in the order thereof, the three trays can be shifted in position in the sheet discharging direction. Accordingly, the post-processing apparatus B can be miniaturized in the vertical direction.

In the present embodiment, the second discharging roller pair 39 is arranged at the first unit 19A. However, not limited to this, the second discharging roller pair 39 may be arranged at the second unit 19B or at a position other than the first unit 19A and the second unit 19B. Further, in the present embodiment, the first discharging roller pair 32 is arranged at the first unit 19A. However, not limited to this, the first discharging roller pair 32 may be arranged at the second unit 19B or at a position other than the first unit 19A and the second unit 19B.

The present application claims the benefit of Japanese Patent Application 2014-252742, filed Dec. 15, 2014, the entire contents thereof are incorporated herein by reference.

What is claimed is:

1. A sheet processing apparatus that performs a punching process on a sheet conveyed from a conveying portion and conveys sheets to a storing portion that stacks the sheets, the storing portion including (a) a fist stack portion that stacks sheets conveyed from the sheet processing apparatus, (b) a second stack portion that stacks sheets conveyed from the sheet processing apparatus, and (c) a processing mechanism that performs a process on a sheet conveyed from the sheet processing apparatus, the sheet on which the processing mechanism has performed the process being discharged to the first stack portion, the sheet processing apparatus comprising:

a punching mechanism that performs the punching process on a sheet at a punching processing position;

a first conveying path that guides a sheet conveyed from the conveying portion to the punching processing position, the sheet guided by the first conveying path being conveyed in a conveying direction, the processing mechanism performing the process on the sheet discharged from a first discharging port of the first conveying path, the sheet on which the processing mechanism has performed the process being discharged to the first stack portion;

a second conveying path that guides a sheet from the conveying portion, the sheet guided by the second conveying path being discharged to the second stack portion from a second discharging port of the second conveying path, the second discharging port being different from the first discharging port, the second conveying path being overlapped with the first conveying path in the conveying direction; and a discharging member that discharges a sheet, guided by the second conveying path, to the second stack portion from the second discharging port, the second stack portion stacking sheets discharged by the discharging member, wherein the second conveying path is detachably attachable to the storing portion integrally with the punching mechanism, and the second conveying path is detachably attachable to the conveying portion integrally with the punching mechanism.

2. The sheet processing apparatus according to claim 1, further comprising:

a conveying member that conveys a sheet, guided by the first conveying path, to the storing portion from the first discharging port.

3. The sheet processing apparatus according to claim 2, wherein the conveying member includes a first discharging roller pair to discharge a sheet to the storing portion, and the discharging member includes a second discharging roller pair to discharge a sheet to the storing portion.

4. The sheet processing apparatus according to claim 1, further comprising a waste box that stores broken pieces of sheets on which the punching process is performed by the punching mechanism.

5. The sheet processing apparatus according to claim 1, wherein the second conveying path includes an introducing port that is different from an introducing port of the first conveying path.

6. The sheet processing apparatus according to claim 1, wherein the processing mechanism is a binding device that performs the process on a sheet discharged from the first discharging port, and the process is a binding process.

7. A sheet processing apparatus to be attached to an image forming apparatus that forms an image on a sheet, comprising:

a punching mechanism that performs a punching process on a sheet at a punching processing position;

a first conveying path that guides a sheet fed from the image forming apparatus to the punching processing position, the sheet guided by the first conveying path being discharged from a first discharging port of the first conveying path;

a second conveying path that guides a sheet fed from the image forming apparatus, the sheet guided by the second conveying path being discharged from a second discharging port of the second conveying path, the second discharging port being different from the first discharging port;

a first stack portion that stacks sheets discharged from the first discharging port;

a second stack portion that stacks sheets discharged from the second discharging port; and a discharging member that discharges a sheet, guided by the second conveying path, to the second stack portion from the second discharging port, a processing mechanism that performs a process on a sheet discharged from the first discharge port, the sheet on which the processing mechanism has performed the process being discharged to the first stack portion, wherein a first unit includes the punching mechanism, the first conveying path, the second conveying path, and the discharging member, a second unit includes the first stack portion, the second stack portion, and the processing mechanism, each of the first unit and the second unit is configured to be detachably attachable to the image forming apparatus, and the first unit is detachably attachable to the second unit.

8. The sheet processing apparatus according to claim 7, wherein the first unit is connected to a conveying portion of the image forming apparatus in case that the first unit is attached, and the second unit is connected to the first unit in case that the first unit is attached and is connected to the conveying portion of the image forming apparatus in case that the first unit is detached.

9. The sheet processing apparatus according to claim 7, wherein the first unit includes a conveying member that conveys a sheet, guided by the first conveying path, to the second unit from the first discharging port.

10. The sheet processing apparatus according to claim 7, wherein the second stack portion of the second unit is arranged at a position where a sheet discharged by the discharging member is stored.

11. The sheet processing apparatus according to claim 7, wherein a sheet guided by the first conveying path is conveyed in a conveying direction, and the second stack portion is overlapped with the processing mechanism in the conveying direction in which a sheet guided by the first conveying path is conveyed.

12. The sheet processing apparatus according to claim 7, wherein the first unit includes a waste box that stores broken pieces of sheets on which the punching process is performed by the punching mechanism.

13. The sheet processing apparatus according to claim 7, wherein the second unit includes a third stack portion that stacks sheets passed through the first conveying path, wherein sheet tailing ends of sheets stacked on the first stack portion are regulated by a first regulating portion, wherein sheet tailing ends of sheets stacked on the second stack portion are regulated by a second regulating portion, wherein sheet tailing ends of sheets on the third stack portion are regulated by a third regulating portion, wherein the first regulating portion, the second regulating portion, and the third regulating portion are arranged as being mutually distanced in the order of the second regulating portion, the third regulating portion, and the first regulating portion toward a conveying direction in which a sheet is guided by the first conveying path.

14. The sheet processing apparatus according to claim 7, wherein the first unit includes a guide face that supports a sheet that is conveyed as being reversed at a conveying portion of the image forming apparatus in a direction of being conveyed and is arranged above the second conveying path.

15. The sheet processing apparatus according to claim 7, wherein the processing mechanism is a binding device that performs the process on a sheet discharged from the first discharging port, and the process is a binding process.

16. The sheet processing apparatus according to claim 7, wherein the second conveying path includes an introducing port that is different from an introducing port of the first conveying path.

17. The sheet processing apparatus according to claim 7, wherein the second conveying path is overlapped with the first conveying path in a conveying direction in which a sheet guided by the first conveying path is conveyed.

* * * * *